US006241401B1

(12) United States Patent
Sanada et al.

(10) Patent No.: US 6,241,401 B1
(45) **Date of Patent: *Jun. 5, 2001**

(54) IMAGE FORMING APPARATUS

(75) Inventors: Kazuo Sanada; Tsutomu Takatsuka; Seiichi Inoue, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/179,843

(22) Filed: Oct. 28, 1998

(30) Foreign Application Priority Data

Mar. 3, 1998 (JP) ..... 10-051085

(51) Int. Cl.[7] ..... G03D 3/02; G03D 5/00
(52) U.S. Cl. ..... 396/604; 396/606; 396/627
(58) Field of Search ..... 396/604, 606, 396/575, 626, 636

(56) References Cited

U.S. PATENT DOCUMENTS 4,929,975 * 5/1990 Shidara ..... 396/627
4,977,422 * 12/1990 Vaughn, IV ..... 396/605
5,027,146 * 6/1991 Manico et al. ..... 396/627
5,217,848 * 6/1993 Uehara et al. ..... 396/627
5,698,382 * 12/1997 Nakahanada et al. ..... 396/604
5,734,945 * 3/1998 Earle et al. ..... 396/604
5,734,946 * 3/1998 Wernicke ..... 396/606
5,960,224 * 9/1999 Sanada et al. ..... 396/604
6,020,948 * 2/2000 Tumidei ..... 396/625

* cited by examiner

*Primary Examiner*—D. Rutledge
(74) *Attorney, Agent, or Firm*—Sughrue, Mion, Zinn, Macpeak & Seas, PLLC

(57) ABSTRACT

Photosensitive material which is a silver halide photosensitive material optimally used for copies of a color film original and the like is coated with developing solution from the nozzle holes of a spray tank. A chamber provided with an internal cavity is disposed on the opposite side of the transporting path to the spray tank with the transporting path sandwiched therebetween. The upper portion of the chamber is covered with a heating plate. The heating plate is pierced with a plurality of suction holes which penetrate from the inside of the chamber to the outside thereof. The unexposed surface of the photosensitive material is suctioned through the suction holes and the heating plate heats the photosensitive material as well as guides the photosensitive material. Downstream of the heating plate on the photosensitive material transporting path D, transporting rollers are disposed for transporting the photosensitive material and for squeezing out developing solution from the photosensitive material.

13 Claims, 12 Drawing Sheets

IMAGE FORMING APPARATUS

BACKGROUND OF THE INVENTION

1. Field of the Invention

The present invention relates to an image forming apparatus for enabling an image to be formed by appropriately coating processing solution on an image recording material such as a photosensitive material or the like.

2. Description of the Related Art

Conventionally, when copies are made of a color film original or a color printing original onto photosensitive material such as a silver halide photosensitive material or the like, the exposure, developing, bleaching/fixing, washing, and drying processes are each performed in sequence on the photosensitive material.

The developing, bleaching/fixing, and washing are carried out by coating the photosensitive material by immersing it in each of storing developing, bleaching/fixing, and washing processing solutions stored in developing, bleaching/fixing, and washing tanks respectively, in sequence.

However, when the photosensitive material is coated by being immersed in the solutions stored in each of the tanks, there are disadvantages such as a large volume of processing solution being required and disposal of the waste solution resulting from the used processing solution being necessary.

SUMMARY OF THE INVENTION

In consideration of the above facts, it is an object of the present invention to provide an image forming apparatus capable of coating a photosensitive material using only a small amount of processing solution and which dispenses with the need for disposing of waste solution.

A first aspect of the present invention is an image forming apparatus for forming an image on an exposed photosensitive material by carrying out a plurality of types of processes in sequence on the photosensitive material, comprising: transporting means for transporting the photosensitive material along a transporting path which guides the photosensitive material; and processing solution supply means which are provided at each stage of the processes and which supply the processing solutions used at each stage on the exposed surface of said photosensitive material.

A second aspect of the present invention is an image forming apparatus for forming an image on an exposed photosensitive material by carrying out a plurality of types of processes in sequence on the photosensitive material, comprising: transporting means for transporting the photosensitive material along a transporting path which guides the photosensitive material; and processing solution supply means which are provided at each stage of the processes and which supply the processing solutions used at each stage on the exposed surface of the photosensitive material, wherein the processing solution supply means comprises processing solution storage tanks, elastically deformable processing solution spray tanks which communicate with the processing solution storage tanks, and piezoelectric elements which are connected to a portion of the side walls of the elastically deformable processing solution spray tanks, and wherein the piezoelectric elements are deformed by energizing the piezoelectric elements, the deformation of the piezoelectric elements increases the pressure on the processing solution inside the processing solution spray tank, and the processing solution is sprayed simultaneously through a plurality of nozzle holes provided in the processing solution spray tank along a direction orthogonal to the direction in which the photosensitive material is transported thereby coating the photosensitive material with the processing solution.

The operation of the image forming apparatus according to the first aspect of the present invention is explained below.

The transporting means transports the photosensitive material along a transporting path which guides the photosensitive material. The processing solution supply means which are provided at each stage of a plurality of types of processes such as developing, bleaching/fixing, and washing processes supplies the processing solution used at each of these stages to the exposed surface of the photosensitive material.

Accordingly, by supplying the respective processing solutions used in each process to the exposed surface of the photosensitive material, the processing solution supply means performs at least developing, bleaching/fixing, washing and the like processes sequentially on the exposed photosensitive material enabling an image to be formed simply on the photosensitive material.

Moreover, in addition to supplying the respective processing solutions used in each process to the exposed surface of the photosensitive material, the processing solution supply means is able to perform the coating using less solution than a coating apparatus which coats a photosensitive material by immersing it in tanks containing processing solution, and the processing solution supply means negates the necessity for disposal of the waste solution resulting from the used processing solution.

The operation of the image forming apparatus according to the second aspect of the present invention is explained below.

In the image forming apparatus according to the second aspect of the present invention, processing solution supply means are provided for supplying the processing solutions used in each of the processes to the exposed surface of a photosensitive material in order to perform the plurality of processes on the exposed photosensitive material while transporting the photosensitive material along a transporting path which guides the photosensitive material using a transporting means. The processing solution supply means is comprised of processing solution storage tanks, elastically deformable processing solution spray tanks which communicate with the processing solution storage tanks, and piezoelectric elements which are connected with a portion of the side walls of the elastically deformable processing solution spray tanks. When energized, these piezoelectric elements are deformed and the deformation causes the pressure on the processing solution inside the processing solution spray tank to increase. The increased pressure causes the processing solution to be coated on the photosensitive material by being sprayed simultaneously from the plurality of nozzle holes provided in the processing solution spray tank along a direction orthogonal to the direction in which the photosensitive material is transported.

Accordingly, because the processing solution is sprayed onto the photosensitive material from the plurality of nozzle holes provided in the processing solution spray tank of the processing solution supply means, the photosensitive material can be coated using a lesser amount of processing solution than an apparatus which processes photosensitive material by immersing it inside processing tanks containing processing solution. Moreover, there is no need to dispose of the waste used processing solution. Further, because the processing solution is sprayed from the plurality of nozzle holes provided in the processing solution spray tank simultaneously along a direction orthogonal to the direction in which the photosensitive material is transported, the photosensitive material can be coated with processing solution across its entire width in a single coating, thereby allowing the processing time to be reduced. In addition, by using piezoelectric elements in the spraying of the processing solution, a compact processing solution supply means with a simple mechanism can be provided. Still further, it is desirable if the piezoelectric elements are driven in synchronization with the speed at which the photosensitive material is transported. This allows the amount of processing solution required for processing the photosensitive material to be kept to a minimum. Moreover, by providing means for heating the photosensitive material, the speed at which the photosensitive material is processed can be increased and the processing itself can be made more stable.

DESCRIPTION OF THE PREFERRED EMBODIMENTS

Figure 1:
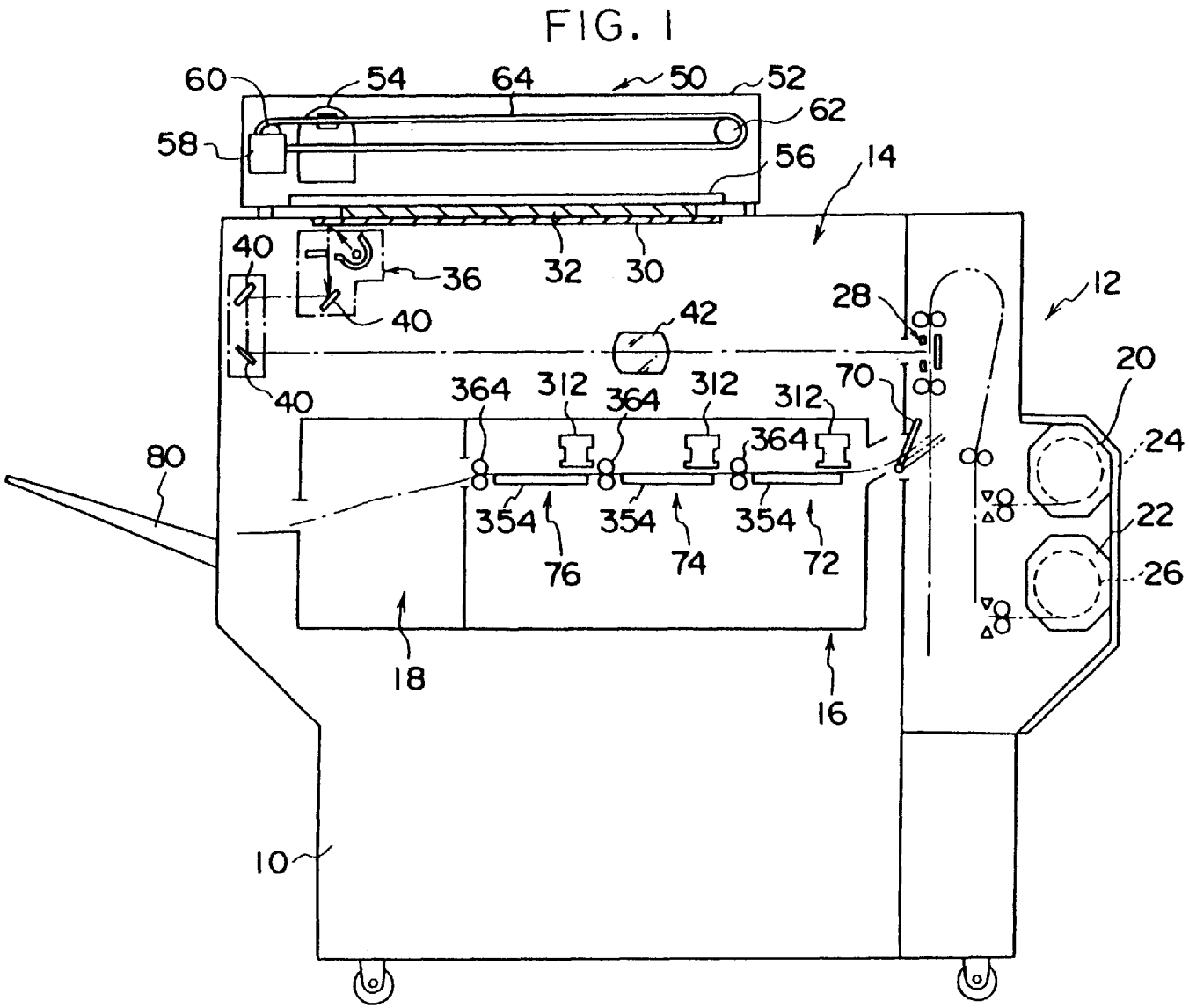
FIG. 1 is an overall schematic structural view of the image recording apparatus according to the first embodiment of the present invention

An overall schematic structural view of the image recording apparatus according to the first embodiment of the present invention is shown in FIG. 1.

As is shown in FIG. 1, a paper supply section 12 is disposed towards the right-hand side inside the body of the apparatus 10 which forms the body of the image recording apparatus. An exposure section 14 is disposed towards the top inside the apparatus body 10 and a processing section 16 is disposed in the central portion inside the apparatus body 10. A drying section 18 is disposed towards the left-hand side inside the apparatus body 10.

Further, a pair of magazines 20 and 22 are loaded in a vertical alignment at the right end portion of the apparatus body 10. Inside the magazines 20 and 22 respectively are housed photosensitive materials 24 and 26 formed in roll shapes from silver halide photographic photosensitive materials in such a way that the leading end of each roll can be pulled out towards the paper supply section 12. It should be noted that the photosensitive material 24 is the optimum material for copies of a color film original, while the photosensitive material 26 is the optimum material for copies of a color printing original.

The photosensitive materials 24 and 26 pulled out of the magazines 20 and 22 are sent through the paper supply section to the exposure window 28. Further, exposure of an image on a color original 32 placed on top of a transparent original stand 30 provided at the top of the exposure section 14 is able to be performed.

A color original 32 is press-contacted onto the original stand 30 by an illumination apparatus 50 and is illuminated by a lamp unit 54 inside the illumination apparatus 50 which travels in synchronization with the scanning of a light source unit 36 directly beneath the original stand 30. A transparent plate 56 (made from glass, acrylic resin, or the like) is fitted opposite the color original 32 into the lower portion of casing 52 which forms the outer frame of the illumination apparatus 50 so that light from the light source lamp unit 54 is irradiated via the transparent plate 56 onto the color original 32.

Next, when the color original 32 is a transparent original, transmitted light, which is transmitted through the transparent color original 32 via unillustrated slits in the lamp unit, is irradiated onto a plurality of mirrors 40 inside the light source unit 36. The transmitted light is transmitted through an optical unit 42 and, by opening unillustrated shutters, it exposes the portion of the photosensitive materials 24 or 26 positioned in the exposure window 28. It should be noted that the optical unit 42 is formed from a condensing lens and a plurality of filters such as, for example, yellow, magenta, and cyan. Further, when the color original 32 is a reflection original, light from the linear light source inside the light source unit 36 is irradiated onto the color original 32 via unillustrated slits, and reflected light reflected from the reflection color original 32 exposes the portion of the photosensitive material 24 or 26 positioned in the exposure window 28 via the plurality of mirrors 40 and the optical unit 42, in the same way as for the transparent color original. When the color original 32 is a reflection original a white reflection plate may be used instead of the transparent plate 56.

A stepping motor 58 equipped with a pulley 60 is disposed at a position to the left-hand side of the lamp unit 54 and a pulley 62 is disposed at a position to the right-hand side of the lamp unit 54. A timing belt 64 is entrained between the two pulleys 62 and 64 and scanning by the lamp unit 54, which has one end thereof fixed in place, is performed at a predetermined position on the timing belt 64 through the driving of the stepping motor 58.

In other words, when the color original 32 is a transparent color original, the image of the transparent color original 32 is irradiated onto the mirrors inside the lamp unit without illuminating the light source inside the light source unit 36 by controlling the stepping motor 58 in such a way that the light source unit 36 is moved in synchronization with the scanning by the lamp unit 56. In contrast to this, when the color original 32 is a reflection color original, the light source inside the light source unit 36 is illuminated and the reflection color original is scanned by moving the light source unit 36 so as to irradiate light onto the reflection color original 32 via unillustrated slits. The photosensitive material 24 or 26 is then exposed in the same way as for the transmission color original.

On the other side of the image recording apparatus, at an intermediate position on the transporting path (a position past the exposure window 28) of the photosensitive materials 26 and 28, is provided a switch guide 70 capable of switching its direction. Accordingly, once all the exposure has been completed, the photosensitive material 24 or 26, which should be moving towards the bottom of FIG. 1, is temporarily transported in the reverse direction. When the leading edge of the photosensitive material has been transported upstream back past the switch guide 70, the transportation is halted, and the switch guide 70 switches its direction so that the photosensitive material can be guided towards the processing section 16.

Inside the processing section 16 are provided in succession a developing section 72, a bleaching/fixing section 74, and a washing section 76 and developing, bleaching/fixing, and washing processings are carried out in succession using processing solutions loaded into the respective sections. After these processings, the photosensitive material 24 or 26 is transported to a drying section 18 where the photosensitive material is dried and then transported to a tray 80.

As described above, a series of tasks such as exposure, developing, bleach fixing, and drying are performed inside the apparatus body 10 thus forming the image on the color original 32 on photosensitive material 24 or photosensitive material 26.

The processing performed on a photosensitive material inside the processing section 16 will now be explained in detail using photosensitive material 24 as an example.

The photosensitive material 24, having completed the exposure thereof, is transported from the side of the switch guide 70 and is sent firstly to the developing section 72 inside the processing section 16. As is shown in FIG. 2, at a position in the developing section 72 facing the transportation path D of the photosensitive material 24 is disposed a spray tank 312 which is a means for supplying a processing solution and which forms a portion of the coating apparatus 310

Figure 2:
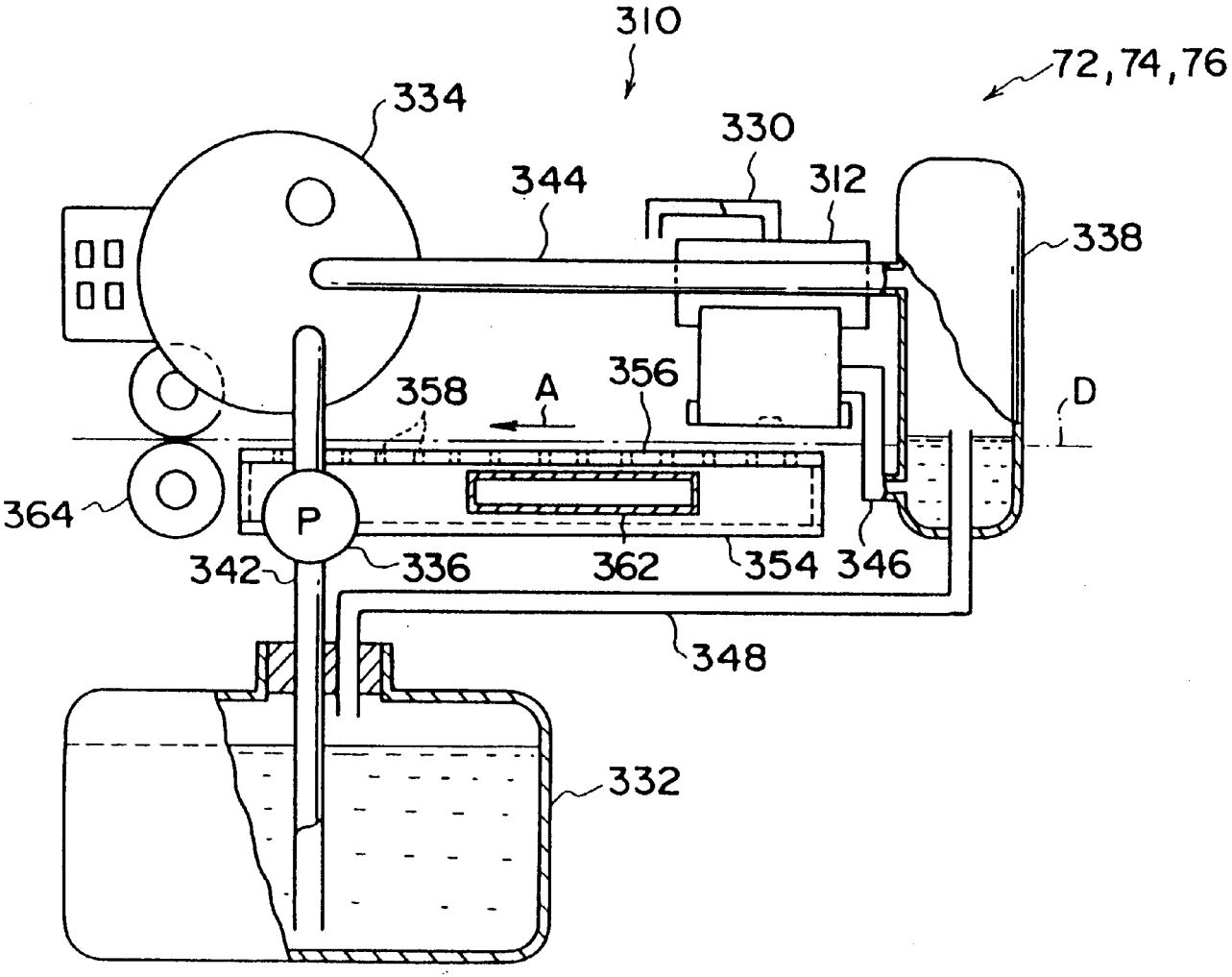
FIG. 2 is an overall schematic structural view of the coating apparatus of the first embodiment of the present invention

As is also shown in FIG. 2, at the bottom left of the spray tank 312 is disposed a developing solution bottle 332 in which developing solution to be supplied to the spray tank 312 is stored. A filter 334 for filtering the developing solution is disposed above the developing solution bottle 332. A solution transporting pipe 342, through which the solution travels and which is provided with a pump 336 near its midway point, connects the developing solution bottle 332 and the filter 334.

At the right-hand side of the spray tank 312 is disposed a sub-tank 338 for storing the developing solution transported from the developing solution bottle 332. The solution transporting pipe 344 extends from the filter 334 to the sub-tank 338.

Accordingly, when the pump 336 is operated, developing solution is transported from the developing solution bottle 332 towards the filter 334 where it is filtered, and is then transported to the sub-tank 338 where it is temporarily stored.

Further, the spray tank 312 is filled with developing solution transported from the developing solution bottle 332 by the pump 336 via the filter 334, the sub-tank 338, and the solution transporting pipe 346 which is disposed between the sub-tank 338 and the spray tank 312 and connects these two tanks.

A circulating pipe 348 having one end thereof connected to the developing solution bottle 332 is connected to the sub-tank 338 and extends so as to penetrate into the inside of the sub-tank 338. The circulating pipe 348 returns any developing solution stored in the sub-tank 338 which is more than the required amount to the developing solution bottle 332.

In addition, as is shown in FIG. 2, a box-shaped chamber 354, which is internally hollow, is disposed opposite the spray tank 312 so as to sandwich the transporting path D of the photosensitive material 24 between itself and the spray tank 312 and extends downstream from the spray tank 312 in the transporting direction of the photosensitive material 24. The top of the chamber 354 is covered with a smooth, flat heating plate 356, which contains an unillustrated heater or the like. The heating plate 356 is pierced at regular intervals with a plurality of suction holes 358 connecting the inside and the outside of the chamber 354.

An unillustrated fan is disposed at one end of the chamber 354 to suction out the air inside the chamber 354, and a duct 362 connects the chamber 354 with this fan.

Accordingly, by operating the fan, the air inside the chamber 354 is suctioned out via the duct 362. At the same time, the uncoated surface of the photosensitive material 24 (the lower-side surface in FIG. 2), is suctioned by the suction holes 358 in the heating plate 356, and the heating plate 356 heats the photosensitive material 24 on the transporting path D as it guides the photosensitive material along the transporting path D.

Transporting rollers 364 comprised of a plurality of rollers are disposed as a transporting means on the downstream side on the transporting path D of the photosensitive material 24 of the spray tank 312 and the heating plate 356 in order to transport the photosensitive material 24 and also to squeeze the developing solution out from the photosensitive material 24 after the developing solution has been sprayed onto the photosensitive material 24.

It should be noted that both the bleaching/fixing section 74 and the washing section 76 have the same structure as described above, and an explanation of these sections is therefore omitted below. However, in place of the developing solution bottle 332, a bleaching/fixing bottle containing bleaching/fixing solution is provided in the bleaching/fixing section 74, and a washing water bottle containing washing water is provided in the washing section 76.

Figure 4:
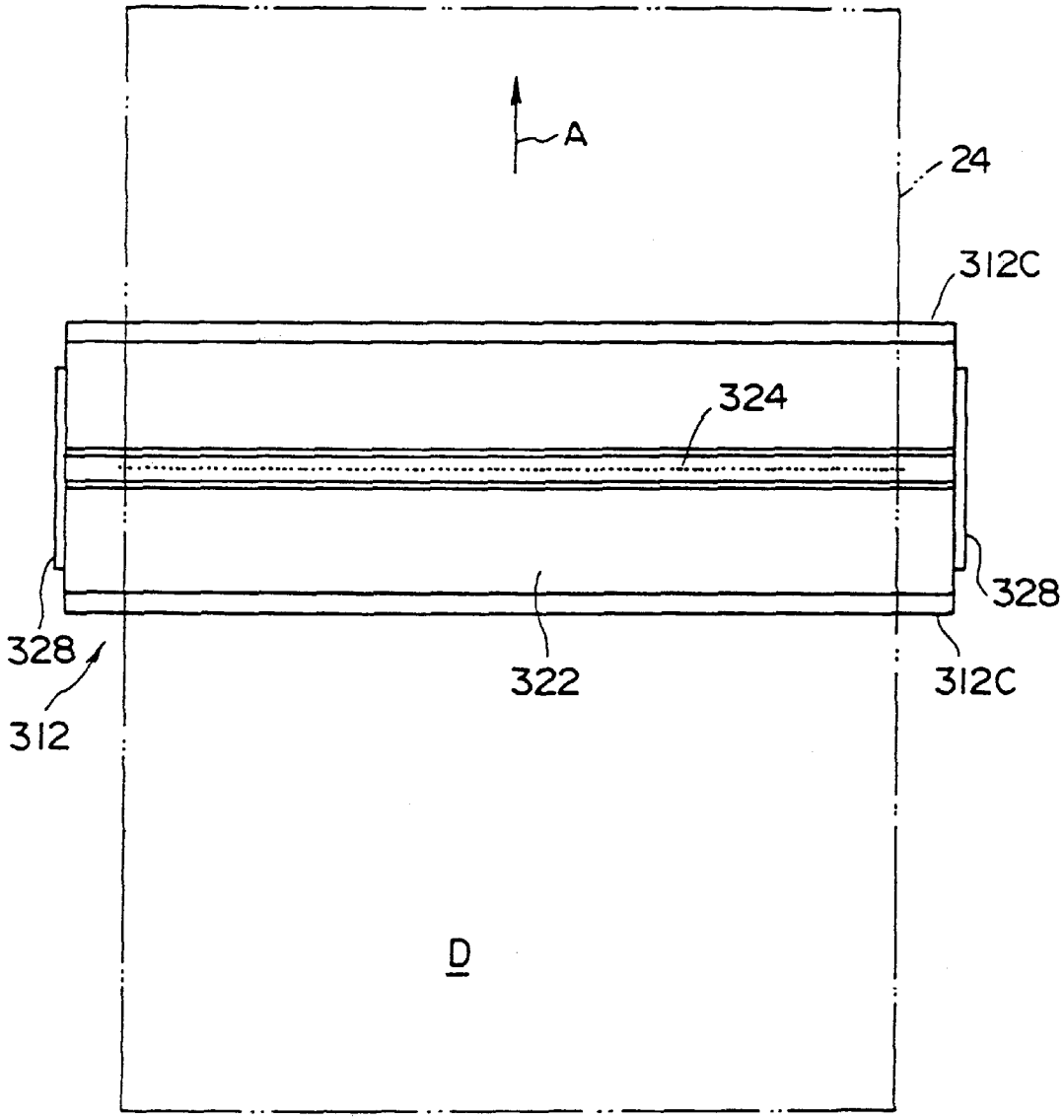
FIG. 4 is a bottom view showing the state when a photosensitive material is transported under the spray tank according to the first embodiment of the present invention.
Figure 6:
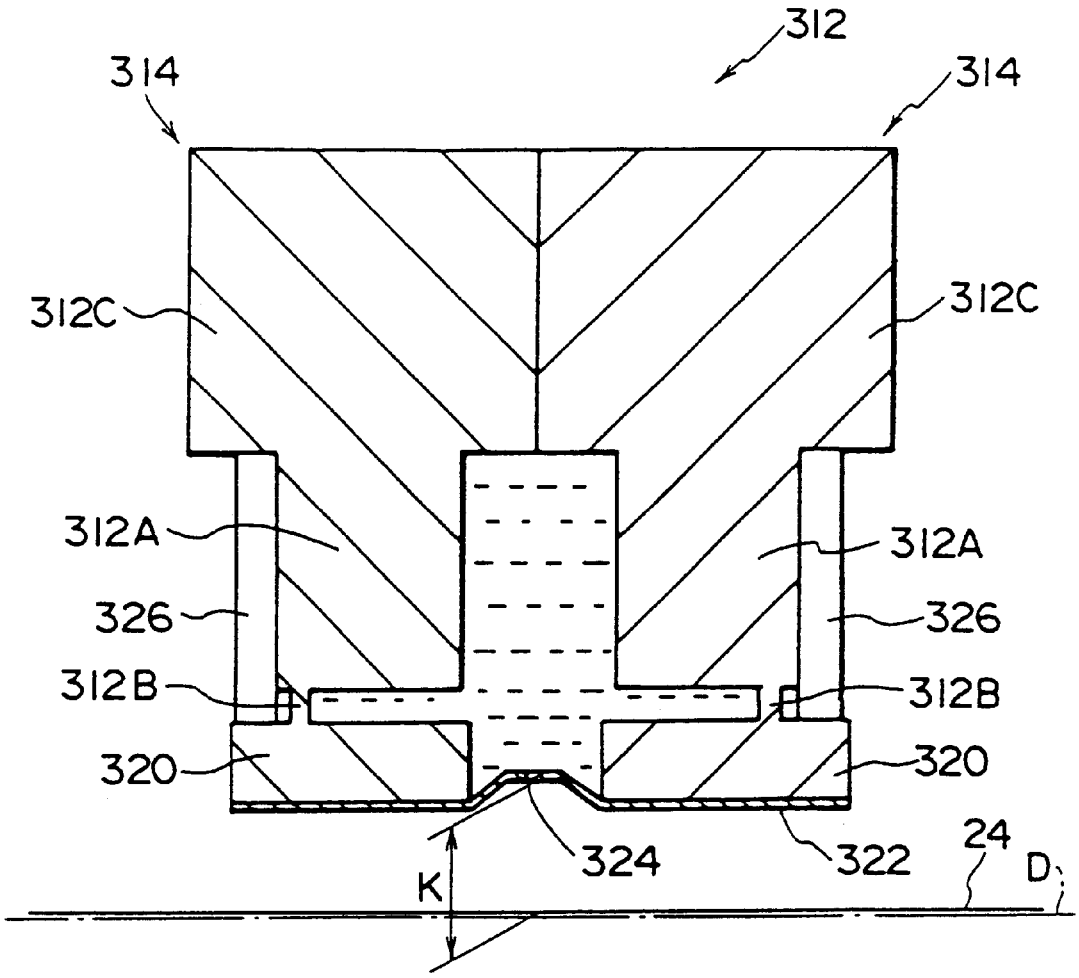
FIG. 6 is a cross-sectional view of the spray tank according to the first embodiment of the present invention.

Further, as is shown in FIGS. 4 and 6, a nozzle plate 322 formed from a bent, elastically deformable, rectangular plate is disposed at a portion of the wall surface of the spray tank 312 which faces the transporting path D of the photosensitive material 24.

Figure 3:
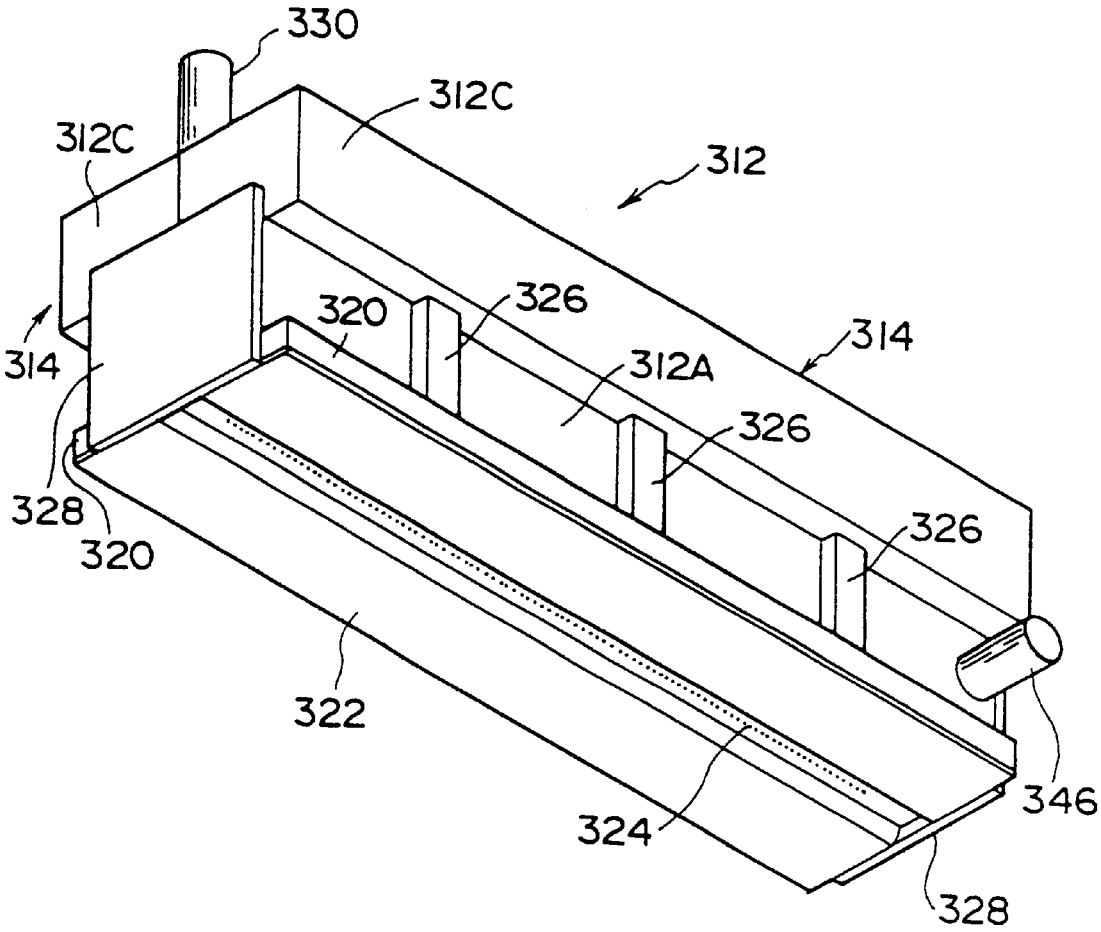
FIG. 3 is an enlarged perspective view of the spray tank according to the first embodiment of the present invention.
Figure 5:
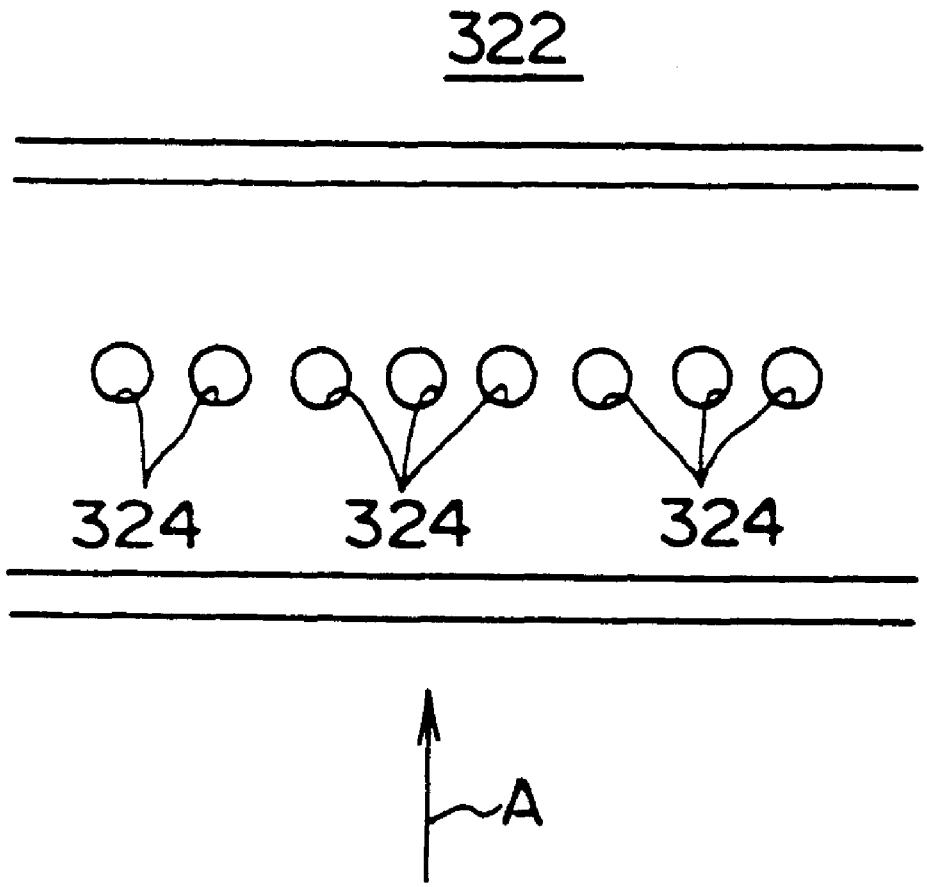
FIG. 5 is an enlarged view of the main portions of FIG. 4

As is shown in FIGS. 3 to 5, a plurality of nozzle holes 324 (having a diameter in the range of several tens of $\mu$m), for spraying the developing solution stored in the spray tank 312, are arranged in a direction perpendicular to the direction of transportation A of the photosensitive material 24 across the entire width of the photosensitive material 24. Because of this, the developing solution stored in the spray tank 312 is able to be discharged towards the photosensitive material 24 through the nozzle holes 324.

On the other hand, as is shown in FIGS. 2 and 3, an exhaust pipe 330 extends from the top portion of the spray tank 312 so as to connect the inside of the spray tank 312 with the outside thereof. An unillustrated valve for opening and closing the exhaust pipe 330 is disposed at a midway position thereon, and the inside of the spray tank 312 can be connected with or shut off from the outside thereof by the opening and closing of this valve.

The end portions of the nozzle plate 322, which extend in a direction perpendicular to the longitudinal direction of the plurality of nozzle holes 324 arranged in a line, are connected by adhesion using an adhesive or the like to pairs of lever plates 320, as is shown in FIG. 6, thus bonding the nozzle plate 322 with the pairs of lever plates 320. The pairs of lever plates 320 are fixed to pairs of side walls 312A via narrow supporting portions 312B formed at the bottom of the pairs of side walls 312A of the spray tank 312.

A portion of a pair of mutually abutting upper walls 312C forming an upper surface of the spray tank 312 projects beyond the outer side of the spray tank 312. Below this projecting upper wall portion 312C, a plurality of piezoelectric elements 326 (three per side in the present embodiment) are disposed by adhesion to serve as actuators. The bottom surfaces of the piezoelectric elements are adhered to the outer ends of the lever plates 320 thereby joining the lever plates 320 to the piezoelectric elements 326.

Accordingly, a lever mechanism is formed using the piezoelectric elements 326, the lever plates 320 and the supporting portions 312B. When the outer end portions of the lever plates 320 are moved by the piezoelectric elements 326, the inner end portions of the lever plates 320 are moved in the opposite direction to the outer end portions. It should be noted that the piezoelectric elements 326 are formed from laminated materials such as piezoelectric ceramics and have a large displacement in their axial direction. In addition, the piezoelectric elements 326 are connected to an unillustrated power source whose voltage application timing is controlled by an unillustrated controller. Moreover, the aforementioned opening/closing valve for the exhaust pipe 330 is also connected to this controller which controls the opening and closing of the valve.

The lever plates 320, side walls 312A, supporting portions 312B, and upper walls 312C each form a part of integrally formed frames 314. As is shown in FIG. 6, a pair of frames 314 are bolted to each other with unillustrated bolts to form the outer frame of the spray tank 312 with the pairs of lever plates 320, side walls 312A, upper walls 312C, and supporting portions 312B each placed in positions opposite to each other.

Further, in the portion demarcated by the left and right-hand ends of the nozzle plate 322, namely the end portions of the nozzle plate 322 going in the longitudinal direction of the row of nozzle holes 324, and by the pair of frames 314, a pair of thin-walled sealing plates 328 are disposed in a state of adhesion to the pair of frames 314 (see FIG. 3).

An elastic adhesive, such as a silicone rubber-based adhesive, is spread inside the sealing plates 328 so as to fill in any gaps between the left and right-hand ends of the nozzle plate 322 and the sealing plates 328, and between the frames 314 and the sealing plates 328, so that there is no leakage of the developing solution therefrom. Accordingly, any gaps in the spray tank 312 are sealed using an elastic adhesive without inhibiting the movement of the left and right-hand ends of the nozzle plate 322. It should be noted that the left and right-hand ends of the spray tank 312 may be sealed using only an elastic adhesive without the thin-walled sealing plates 328.

As can be understood from the above, when the piezoelectric elements 326 are energized by the power source, then the piezoelectric elements 326 are lengthened and the lever plates 320 are levered around the supporting portion 312B. At the same time, the piezoelectric elements 326 cause the central portion of the nozzle plate 322 to be lifted in the direction of the arrow B (in FIG. 7) by deforming and displacing the nozzle plate 322. When the nozzle plate 322 is deformed, the pressure on the developing solution inside the spray tank 312 is increased and a small amount of the developing solution L is sprayed from all the nozzle holes at once 324 along the line thereof.

It should be noted that the spray tanks 312 of the bleaching/fixing section 74 and the washing section 76 are constructed and operate in the same way as described above.

Next the operation of the present embodiment will be explained.

When the photosensitive material 24 has been transported from the magazine 20 and exposure thereof completed, it is transported to the processing section 16, where it is firstly transported towards the bottom side of the spray tank 312 in the developing section 72. Next, the photosensitive material 24 is transported along the transporting path D where it is sprayed with developing solution by the developing solution spraying action of the spray tank 312. This operation is explained below.

Namely, the spray tank 312, which stores developing solution and which is positioned facing the transportation path D of the photosensitive material 24, sprays developing solution onto the photosensitive material 24. The transporting rollers 364,which are positioned downstream on the transporting path D of the photosensitive material 24 from the spray tank 312, squeeze the developing solution from the photosensitive material 24 after it has been sprayed therewith, and also transports the photosensitive material 24 further downstream.

The heating plate 356 is disposed between the spray tank 312 and the transporting roller 364 on the opposite side of the transporting path D of the photosensitive material 24 from the spray tank 312, so as to sandwich the transporting path D of the photosensitive material 24 between the spray tank 312 and the heating plate 356. The photosensitive material 24 is suctioned by the suction holes 358 in the heating plate 356 and is heated by the heating plate 356 on the transporting path D while, at the same time, it is guided by the heating plate 356 as it is transported.

More specifically, the photosensitive material 24 is transported along the transporting path D from the switch guide 70 and, after developing solution has been adhered to the leading end of the photosensitive material 24 through the spray from the spray tank 312, the photosensitive material 24 is sent sliding along the top of the heating plate 356 until the leading edge of the photosensitive material 24 is nipped by the transporting rollers 364. The transportation of the photosensitive material 24 is then halted for approximately several seconds while the photosensitive material 24 is heated by the heating plate 356.

Next, transportation of the photosensitive material 24 is begun once again by the transporting rollers 364 and the portion of the photosensitive material 24 which has had the developing solution coated thereon is transported from the top of the heating plate 356.

Accordingly, the heating plate 356 suctions the photosensitive material 24 by the suction holes 358 so that the photosensitive material 24 is slid along adhering to the heating plate 356, while being guided by the heating plate 356. Therefore, when the spray tank 312 sprays out the developing solution, the clearance K (see FIG. 6) between the spray tank 312 and the photosensitive material 24 is kept constant. Because of this, there are no portions of the surface of the photosensitive material 24 to which the developing solution does not adhere, and uniform coating of the surface of the photosensitive material is possible.

Further, as was stated above, the heating plate 356 is disposed on the opposite side to the spray tank 312 with the transporting path D of the photosensitive material sandwiched therebetween, which is the side facing the side of the photosensitive material which is not coated with the developing solution. Because of this, it is no longer necessary to transport the photosensitive material 24 with the coated surface, which is the light-sensitive surface thereof, contacting the transporting roller or the like, after the developing solution has been coated on the photosensitive material 24 and before the developing solution has penetrated into the photosensitive material 24. In addition, the developing solution can be made to penetrate into the photosensitive material 24 in a short time by heating the photosensitive material 24 using the heating plate 356, thus causing no loss in image quality of the image on the photosensitive material 24.

When the photosensitive material is inserted and nipped between the transporting rollers 364, then, even if the photosensitive material 24 receives a shock, the heating roller 356 is able to guide the photosensitive material 24 between the spray tank 312 and the transporting rollers 364 while suctioning it with the suction holes 358, and because the photosensitive material 24 is suctioned by these suction holes 358, no shock is received by the portion of the photosensitive material 24 positioned opposite the spray tank 312, and as a result, the developing solution can be coated more uniformly onto the photosensitive material 24.

It should be noted that before the developing solution is sprayed by the spray tank 312, the valve on the exhaust pipe 330 must first be shut by the controller. In order to atomize and spray the developing solution in this state, a voltage is applied to the piezoelectric elements 326 by energizing from the power source controlled by the controller, and all the piezoelectric elements 326 are made to extend their length at the same time.

When the plurality of piezoelectric elements 326 are stretched and contracted so as to extend at the same time, then each one of the pair of lever plates 320 is swung around the supporting portion 312B, and the portion of the nozzle plate 322 adjacent to the nozzle holes 324, which are positioned between the pair of lever plates 320, is moved up and down (in this case, in the direction indicated by the arrow B in FIG. 7) along a direction facing towards the photosensitive material 24 on the transporting path D. This movement of the nozzle plate 322 exerts pressure on the developing solution inside the spray tank 312.

Figure 7:
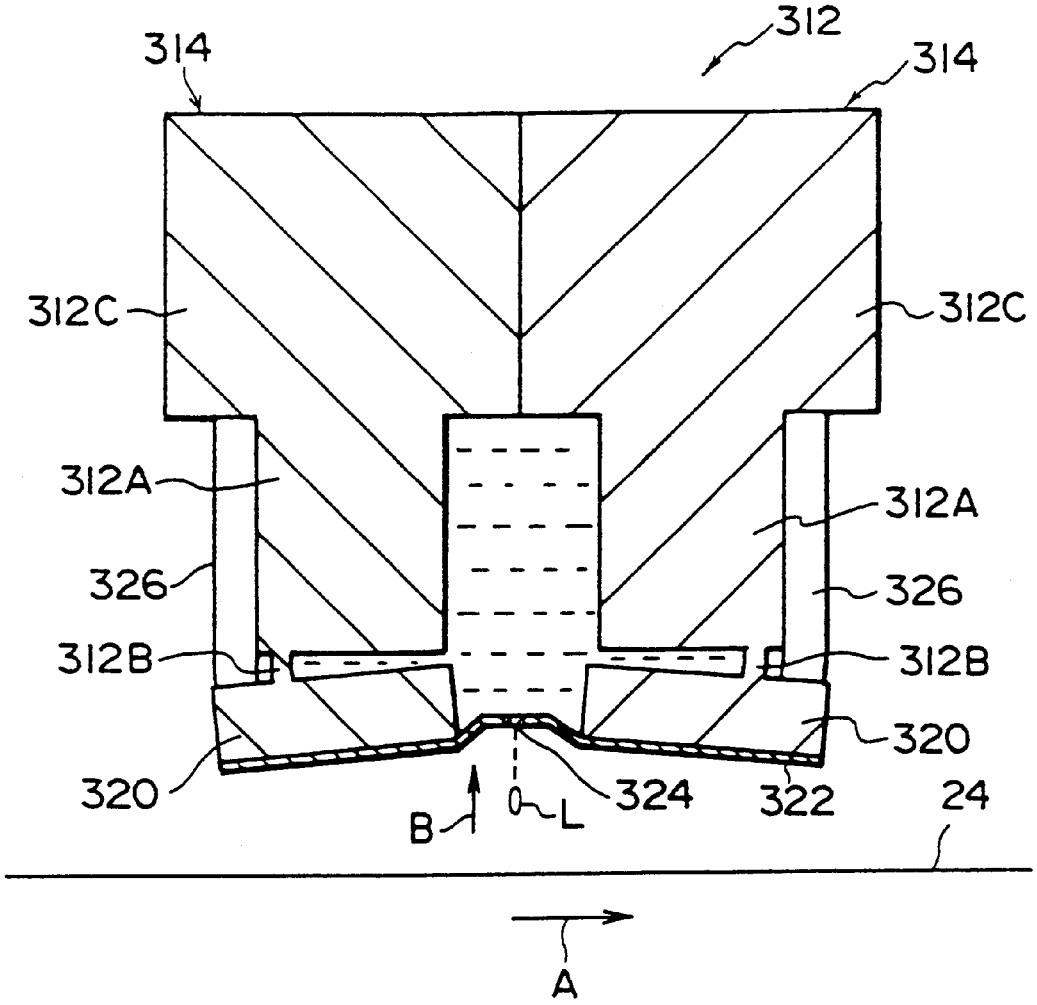
FIG. 7 is a cross-sectional view showing the state when water is sprayed from the spray tank according to the first embodiment of the present invention.

As seen from the above, the developing solution stored in the spray tank 312 is sprayed out from the plurality of nozzle holes 324 in accordance with the action of the piezoelectric elements 326. As a result, as is shown in FIG. 7, the developing solution stored in the spray tank 312 can be atomized as it is sprayed out from the nozzle holes 324, thereby causing the developing solution to adhere to the surface of the photosensitive material 24 as it is being transported.

In this case, the plurality of nozzle holes 324 in the nozzle plate 322 provided in the spray tank 312 as a portion of the wall surface of the spray tank 312 for spraying the developing solution are disposed so as to extend across the entire width of the photosensitive material 24. The lever plates 320, extending along the direction in which the plurality of nozzle holes 324 are aligned, are swung around the supporting portions 312B. Because of this, the entire portion of the nozzle plate 322 which is provided with the plurality of nozzle holes 324 is uniformly displaced and the developing solution stored in the spray tank 312 is sprayed from each of the plurality of nozzle holes 324.

Accordingly, because the spray tank 312 is equipped with the nozzle holes 324, and sprays the developing solution from the nozzle holes 324, then a smaller amount of developing solution can be used for the coating compared to a coating apparatus which coats a photosensitive material and the like by immersing it in a developing solution stored in a tank. In addition, it is not only unnecessary to treat the developing solution which has been used and is therefore waste solution, but the developing solution can also be dried in a short time.

In addition, because the spray tank 312 is equipped with a plurality of nozzle holes 324 disposed across the entire width of the photosensitive material 24 and the developing solution is sprayed from the plurality of nozzle holes 324 simultaneously by a single displacement of the piezoelectric elements 326, the developing solution can be coated over a wide range, i.e. the entire width of the photosensitive material 24, with a single spraying action and, therefore, coating time can also be reduced.

Further, lever plates 320 are connected to both end portions of the nozzle plate 322 which are orthogonal to the longitudinal direction of the row of nozzle holes 324 and the nozzle plates 322 are connected to the piezoelectric elements 326 via these lever plates 320. Therefore, the nozzle holes 324 can all be stably displaced at the same time by an identical displacement amount along the direction of the plurality of nozzle holes arranged in a line allowing the developing solution to be evenly coated onto the photosensitive material 24.

Further, by spraying the developing solution from the plurality of nozzle holes 324 a plurality of times at an arbitrary timing in synchronization with the transporting speed of the photosensitive material 24, the developing solution can be evenly coated across the entire surface of the photosensitive material 24.

Because the diameter of the droplets is regulated by the size of the nozzle holes 324 and because no gas is mixed with the solution, there is no unevenness in the diameter of the droplets. Moreover, because the nozzle holes 324 are disposed at regular intervals in a straight line, there is no unevenness in the sprayed positions. Because of this, there is no inhibiting action from any unevenness on the uniformity of the solution on the surface of the photosensitive material 24, i.e. the coated surface.

In addition, because the plurality of nozzle holes are disposed at regular intervals in a straight line along a direction intersecting the direction of transportation of the photosensitive material 24, there is no need for the nozzle plates 322 to scan across a two-dimensional plane and a large surface area can be coated in a short time. Moreover, because the nozzle plates 322 provided with the plurality of nozzle holes 324 do not make direct contact with the photosensitive material 24, there is no clogging or contamination and the durability of the coating apparatus 310 is improved.

Because the nozzle plate 322 only needs to simply have a plurality of nozzle holes 324 formed therein, integrated technology is unnecessary and the coating apparatus 310 can be produced at a low cost.

When the developing solution is sprayed from the nozzle holes 324 in the nozzle plate 322, the amount of developing solution contained in the spray tank 312 gradually decreases. However, the sub-tank 338 functions by supplying developing solution to the spray tank and, therefore, the level of the liquid in the spray tank 312 is kept constant. This enables the water pressure inside the spray tank 312 to be kept at a constant value during atomization and a continuous spray of developing solution can be ensured.

After this, the photosensitive material 24, having been coated with developing solution serving as a processing solution in the developing section 72, is transported by the transporting roller 364 to the bleaching/fixing section 74, where it is coated with bleaching/fixing solution in the same way as is described above. It is then transported to the washing section 76 where it is coated with washing water. The operations performed in the bleaching/fixing section and the washing section, however, are performed in the same way as is described above and all the above processes are carried out in continuous sequence.

Figure 8:
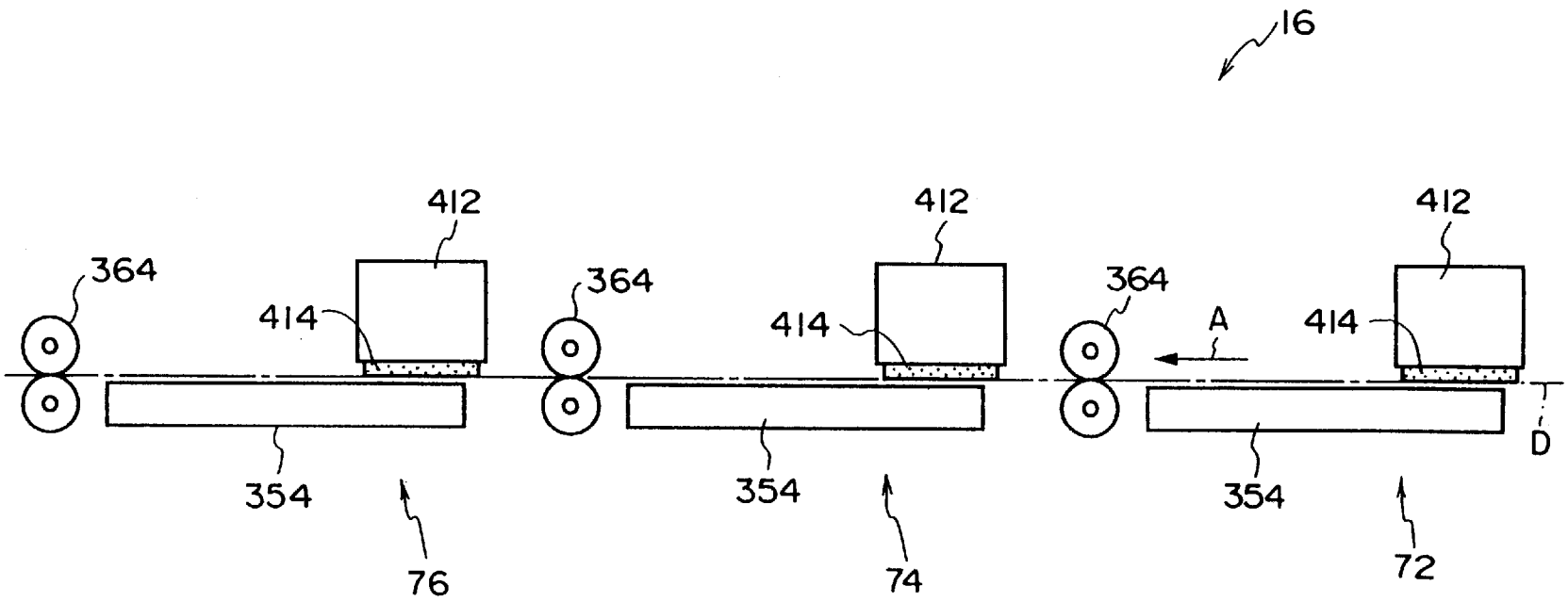
FIG. 8 is a schematic structural view of a processing section according to the second embodiment of the present invention.

Next, the image forming apparatus relating to the second embodiment of the present invention, which is shown in FIG. 8, will be explained. It should be noted that members which are identical to members described in the first embodiment of the present invention have the same symbols attached thereto and a detailed description thereof is omitted.

In the present embodiment, as is shown in FIG. 8, felt 414 is disposed at the bottom portion of coating tanks 412, which are processing solution supply means having processing solutions stored therein. The light-sensitive material 24 abuts the felt 414 when being transported and the various processing solutions are supplied via the felt after oozing through from the coating tanks 412.

As seen above, by means of a compact and low cost apparatus structure using felt, coating can be performed using a small amount of processing solution and the treatment of waste solution becomes unnecessary. Moreover, uniform coating of processing solution on the photosensitive material 24 can be achieved. It should be noted that another processing solution impregnated coating means such as a sponge or the like may be used instead of the felt 414.

Figure 9:
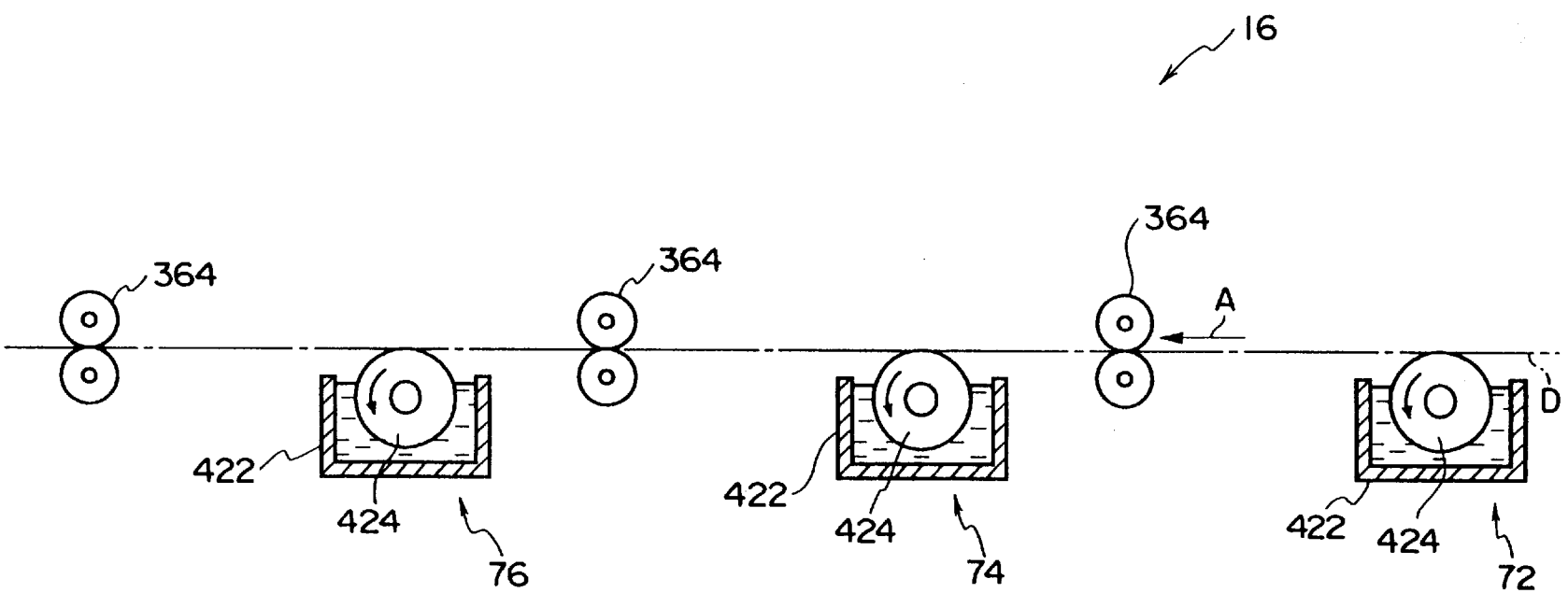
FIG. 9 is a schematic structural view of a processing section according to the third embodiment of the present invention.

Next, the image forming apparatus relating to the third embodiment of the present invention, which is shown in FIG. 9, will be explained. It should be noted that members which are identical to members described in the first embodiment of the present invention have the same symbols attached thereto and a detailed description thereof is omitted.

In the present embodiment, as is shown in FIG. 9, coating rollers 424 are rotatably disposed inside processing solution tanks 422 which are filled with processing solution. The coating rollers 424 are constructed so as to be rotated by a driving means such as an unillustrated motor or the like. Namely, the processing solution supply means is composed of these processing tanks 422 and the coating rollers 424.

Accordingly, the photosensitive material 24 is transported while abutting the external peripheral surface of the coating roller 424 which is protruding above the surface of the processing solution. Processing solution, which has adhered to the external peripheral surface of the coating roller 424, is then adhered to the bottom surface of the photosensitive material 24 in conjunction with the rotation of the coating rollers 424 thus supplying the photosensitive material 24 with processing solution.

As seen above, by means of a compact and low cost apparatus structure using processing tanks 422 and coating rollers 424, coating can be performed using a small amount of processing solution and the treatment of waste solution becomes unnecessary. Moreover, uniform coating of processing solution on the photosensitive material 24 can be achieved.

Figure 10:
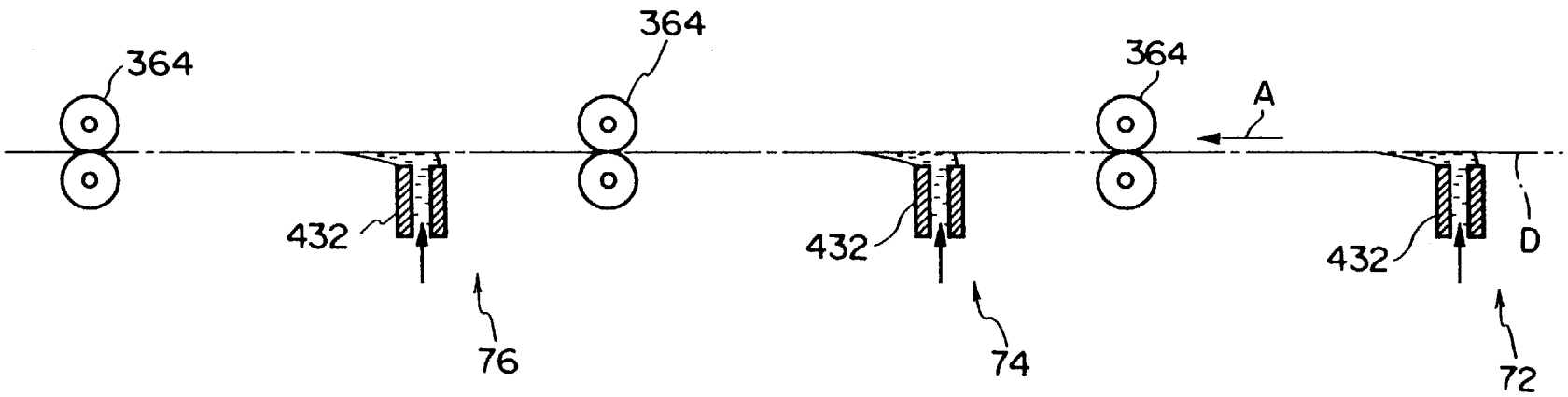
FIG. 10 is a schematic structural view of a processing section according to the fourth embodiment of the present invention.

Next, the image forming apparatus relating to the fourth embodiment of the present invention, which is shown in FIG. 10, will be explained. It should be noted that members which are identical to members described in the first embodiment of the present invention have the same symbols attached thereto and a detailed description thereof is omitted.

In the present embodiment, slit-shaped solution feed-pipes 432, which are a processing solution supply means and which are connected via solution feed-pumps to an unillustrated tank filled with processing solution, have the longitudinal direction thereof intersecting the direction of transportation of the photosensitive material 24. The solution feed-pipes 432 are disposed in positions abutting the transportation path D of the photosensitive material 24.

The photosensitive material 24 is transported while abutting the upper end portion, i.e. the distal end portion, of the solution feed-pipes 432. The processing solution, which is fed up from inside the upper end portion of the solution feed-pipes 432, adheres to the bottom surface of the photosensitive material 24 thus supplying the photosensitive material 24 with processing solution.

As seen above, by means of a compact and low cost apparatus structure using slit-shaped solution feed-pipes 432, coating can be performed using a small amount of processing solution and the treatment of waste solution becomes unnecessary. Moreover, uniform coating of processing solution on the photosensitive material 24 can be achieved.

Figure 11:
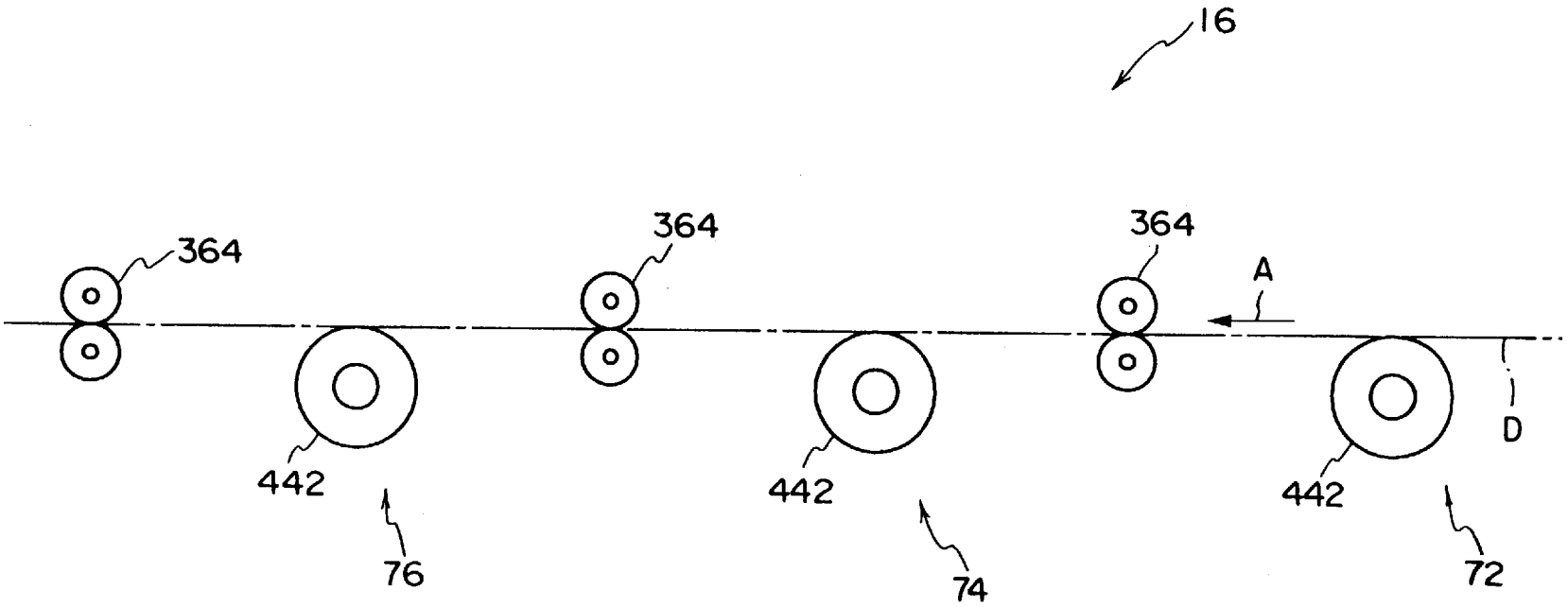
FIG. 11 is a schematic structural view of a processing section according to the fifth embodiment of the present invention.

Next, the image forming apparatus relating to the fifth embodiment of the present invention, which is shown in FIG. 11, will be explained. It should be noted that members which are identical to members described in the first embodiment of the present invention have the same symbols attached thereto and a detailed description thereof is omitted.

In the present embodiment, a processing solution supply means comprising porous rollers 442, which have a plurality of unillustrated holes in the outer peripheral surface thereof and which have the processing solution impregnated into the hole portions, as is shown in FIG. 11, are disposed in positions abutting the transportation path D of the photosensitive material 24. The porous rollers 442 are constructed so as to be rotated by a driving means such as an unillustrated motor or the like. In this case, the shafts of the porous rollers 442 are constructed as hollow pipes. By supplying the processing solution to these hollow pipes, the processing solution is made to exude to the surface of the porous rollers 442.

Accordingly, the photosensitive material 24 is transported while abutting the outer peripheral surface of the of the porous rollers 442 thereby adhering the processing solution exuding from the plurality of holes formed in the outer peripheral surface of the porous rollers 442 onto the bottom surface of the photosensitive material 24, thus supplying the photosensitive material with processing solution.

As seen above, by means of a compact and low cost apparatus structure using porous rollers 442, coating can be performed using a small amount of processing solution and the treatment of waste solution becomes unnecessary. Moreover, uniform coating of processing solution on the photosensitive material 24 can be achieved.

Figure 12:
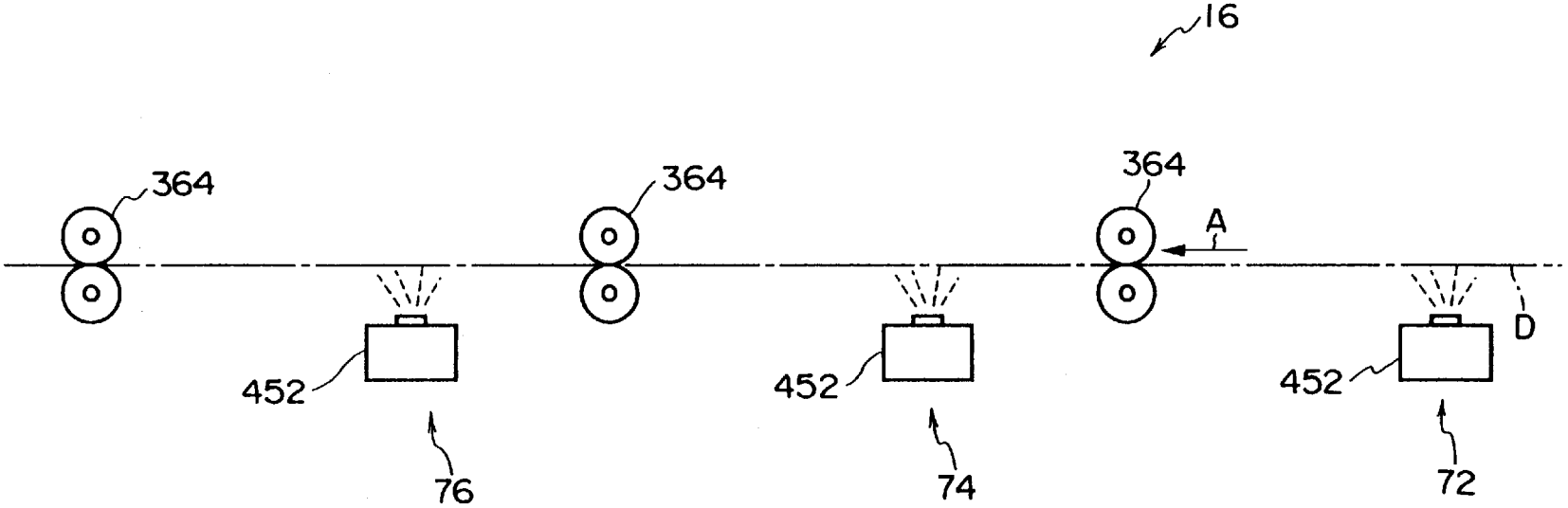
FIG. 12 is a schematic structural view of a processing section according to the sixth embodiment of the present invention.

Next, the image forming apparatus relating to the sixth embodiment of the present invention, which is shown in FIG. 12, will be explained. It should be noted that members which are identical to members described in the first embodiment of the present invention have the same symbols attached thereto and a detailed description thereof is omitted.

In the present embodiment, a processing solution supply means comprising spray tanks 452, which have unillustrated spray holes in the top surface thereof so as to spray processing solution, as is shown in FIG. 12, are disposed facing the transportation path D of the photosensitive material 24.

Accordingly, the processing solution is sprayed by the atomizing spray tanks 452, thereby adhering the processing solution onto the bottom surface of the photosensitive material 24, thus supplying the photosensitive material with processing solution.

As seen above, by means of a compact and low cost apparatus structure using spray tanks 452, coating can be performed using a small amount of processing solution and the treatment of waste solution becomes unnecessary. Moreover, uniform coating of processing solution on the photosensitive material 24 can be achieved.

It should be noted that, in the above embodiments, transporting rollers 364 are employed as transporting means to transport the photosensitive material along the transportation path, however, a construction which uses transporting means such as a belt, for example, may also be employed. In this case, the photosensitive material may be transported in a state where it is securely placed on the belt using negative pressure, an adhesive, or the like.

Moreover, in the first and second embodiments described above, the processing solutions are supplied from the top with the top surface of the photosensitive material being the exposure surface. In embodiments three to six described above, the processing solutions are supplied from the bottom with the bottom surface of the photosensitive material being the exposure surface. However, the exposure surfaces may be inverted in each of the above-described embodiments and, accordingly, the processing solutions also supplied from the opposite side than in the above-described embodiments. Further, in embodiments three to six described above, the chamber 354 was not illustrated, however, a chamber 354 may also be provided in each of the above-described embodiments.

In the above-described embodiments, a description was given using an image recording apparatus which uses silver halide photosensitive materials, however, the photosensitive material of the present invention is not limited to such. Other appropriate sheet-shaped or roll-shaped photosensitive materials may also be used. In addition, processing solutions other than developing solutions and the like may be coated onto the photosensitive material.

Further, in the above-described first embodiment, the straight line of nozzle holes 324 in the nozzle plate which serve as the nozzles of the spray tank 312 are aligned in a direction intersecting the direction of the path of transportation D of the photosensitive material at regular intervals and are arranged in a single line across the entire width of the photosensitive material, however, the row of nozzle holes may be provided as, for example, two or more staggered rows.

In this case, because the row of nozzles comprises straight lines of nozzle holes 324 which are aligned in a direction intersecting the direction of the path of transportation of the photosensitive material at regular intervals and are arranged in a plurality of rows across the entire width of the photosensitive material, a large number of drops of solution can be adhered to the surface of the photosensitive material in a small number of displacements allowing the photosensitive material to be coated a plurality of times or at the closest packing. This allows an increase in the amount of coating and an improvement in the uniformity of the coating.

As has been described above, the image forming device of the present invention possesses the excellent effects of allowing coating to be performed with a small amount of processing solution and negating the necessity of treating waste solution.

What is claimed is:

1. An image forming apparatus for forming an image on an exposed photosensitive material by carrying out a plurality of types of processes in sequence on said photosensitive material, comprising:

transporting means for transporting said photosensitive material along a transporting path which guides said photosensitive material; and processing solution supply means which are provided at each stage of the plurality of types of processes and which supply the processing solutions used at each stage on a single exposed surface of said photosensitive material at a time, wherein said processing solution supply means comprises processing solution storage tanks, elastically deformable processing solution spray tanks which communicate with said processing solution storage tanks, and piezoelectric elements which are connected to a portion of the side walls of said elastically deformable processing solution spray tanks, and wherein said piezoelectric elements are deformed by energizing said piezoelectric elements, said deformation of said piezoelectric elements increases the pressure on the processing solution inside said processing solution spray tank, and said processing solution is sprayed simultaneously through a plurality of nozzle holes provided in said processing solution spray tank along a direction orthogonal to the direction in which said photosensitive material is transported thereby coating said photosensitive material with said processing solution.

2. The image forming apparatus according to claim 1, wherein a plurality of piezoelectric elements are provided along a direction orthogonal to the direction in which said photosensitive material is transported and said plurality of piezoelectric elements are driven simultaneously.

3. The image forming apparatus according to claim 2, wherein said photosensitive material and said plurality of nozzle holes provided in said processing solution spray tank are moved relative to each other, and said photosensitive material is coated with processing solution by being sprayed with said processing solution from said plurality of nozzle holes simultaneously.

4. The image forming apparatus according to claim 3, wherein a mechanism is provided for deforming said processing solution spray tank by expanding the deformation of said piezoelectric elements.

5. The image forming apparatus according to claim 4, wherein said plurality of piezoelectric elements are driven in synchronization with the speed at which said photosensitive material is transported.

6. The image forming apparatus according to claim 5, wherein means for heating said photosensitive material is provided on an opposite side to the single exposed surface of said photosensitive material.

7. The image forming apparatus according to claim 6, wherein means for removing each of the processing solutions is provided at the end of each processing stage of said photosensitive material.

8. The image forming apparatus according to claim 3, wherein said plurality of piezoelectric elements are driven in synchronization with the speed at which said photosensitive material is transported.

9. The image forming apparatus according to claim 8, wherein means for heating said photosensitive material is provided on an opposite side to the single exposed surface of said photosensitive material.

10. The image forming apparatus according to claim 2, wherein a mechanism is provided for deforming said processing solution spray tank by expanding the deformation of said piezoelectric elements.

11. The image forming apparatus according to claim 10, wherein said plurality of piezoelectric elements are driven in synchronization with the speed at which said photosensitive material is transported.

12. The image forming apparatus according to claim 11, wherein means for heating said photosensitive material is provided on an opposite side to the single exposed surface of said photosensitive material.

13. The image forming apparatus according to claim 12, wherein means for removing each of the processing solutions is provided at the end of each processing stage of said photosensitive material.

* * * * *